United States Patent [19]

Deutsch

[11] 4,392,556

[45] Jul. 12, 1983

[54] ACTUATOR LOCKING DEVICE

[75] Inventor: Edward J. Deutsch, Bellmore, N.Y.

[73] Assignee: Arkwin Industries, Inc., Westbury, N.Y.

[21] Appl. No.: 175,419

[22] Filed: Aug. 5, 1980

Related U.S. Application Data

[62] Division of Ser. No. 936,788, Aug. 25, 1978, Pat. No. 4,240,332.

[51] Int. Cl.[3] ..... F01B 25/26

[52] U.S. Cl. ..... 188/67; 92/21 MR; 92/23

[58] Field of Search ..... 92/5 R, 5 L, 24, 27, 92/85 A, 85 B, 21 MR, 23, 28, 21 R, 30; 91/395, 407; 188/67

[56] References Cited

U.S. PATENT DOCUMENTS

| | | | |
|---|---|---|---|
| 2,295,961 | 9/1942 | Meyer | 92/5 L |
| 3,177,780 | 4/1965 | Andersen | 92/5 L |
| 3,186,308 | 6/1965 | Butterworth | 92/23 |
| 4,295,413 | 10/1981 | Kamimura | 92/5 L |

*Primary Examiner*—Abraham Hershkovitz
*Attorney, Agent, or Firm*—Leon J. Bercovitz

[57] ABSTRACT

A fluid pressure actuator which locks in the extended position. The lock is a roller operated, dual segment pawl mechanism that unlocks in response to a pressure difference between extend and retract pressures. The two lock segments, chamfered for engagement with the cylinder end, are in diametrically opposed slots in the actuator piston head. A cylindrical section projects from the segment portion. An end view of the lock is mushroom shaped. Two rollers, held in alignment normal to the actuator centerline by a cage integral with an unlock rod, operate in conjunction with the lock cam surfaces in such a manner as to carry the radial loading imposed when in the lock mode.

The rolling action of the rollers, combined with the radial application of locking force provides low friction operation of the lock.

5 Claims, 5 Drawing Figures

ACTUATOR LOCKING DEVICE

This is a division, of application Ser. No. 936,788, filed Aug. 25, 1978, now U.S. Pat. No. 4,240,332.

BACKGROUND OF THE INVENTION

The present invention related to fluid pressure operated actuators and more particularly to a fluid pressure actuator and locking means for locking the actuator in the extended position, which may be utilized in the landing gear structure of aircraft or for any other application where it is desired to utilize fluid pressure activated means for moving an element to an extended position and for thereafter locking the element in such position.

Heretofore, numerous types of fluid pressure actuators incorporating locking means have been proposed and utilized, particularly in connection with the aircraft industry, and while these prior art devices have operated satisfactorily insofar as providing a motive force for moving an element from one position to another, the locking means incorporated therein have not been entirely satisfactory.

Some prior art locking means have involved relatively delicate toggle mechanisms, with consequent liability to failures, and have been relatively complex and costly to manufacture and repair. Also, in some instances, as the result of wear, play has developed between the parts of the locking mechanism, which has sometimes resulted in failure to provide a positive lock with the result that inadvertent movement of the element operated by the fluid pressure actuator has taken place, which in certain instances could be disastrous.

Other prior art locking means involve rollers secured within recesses of plungers, the rollers operating against camming surfaces to operate locking detents, but those proposed require sliding action of the rollers under the high radial loads induced in the detents. One such prior art device is the subject of U.S. Pat. No. 3,107,582 to Royster. Referring to FIG. 2 of this patent, the detents 65 are loaded in the direction shown by the arrow due to the load applied against the detent by the level surface 66. Retraction of the plunger 58 in the direction shown by the arrow is necessary to release the lock. While rolling action between the roller 74 and the detent cam surface 67 is obtained, sliding action is required between the rollers and their recess 70. It is characteristic of sliding friction that the magnitude of the friction is proportional to the loading normal to the surfaces. Furthermore, the exact value of the coefficient of friction varies considerably with the production pieces. These characteristics, in combination, result in large variations in the force necessary to move the plunger. This, in turn, introduces a large spread between the hydraulic pressure below which the actuator cannot unlock and that above which it will always unlock. A further disadvantage of the sliding friction is the tendency for high axial loads on the plunger should a detent become "sticky" in the locking-mode. This axial force can overcome the force applied by the plunger spring and prevent the detents from locking.

An actuator which locks in the retracted position is known which is generally similiar to that of Royster U.S. Pat. No. 3,107,582 except that a cage is provided at the outer end of a locking piston and the rollers are held in alignment normal to the center line of the actuator by the cage but are unrestrained radially by the cage or locking piston.

OBJECTS OF THE INVENTION

The main object of the present invention is to provide a reliable extended position lock mechanism for a fluid pressure actuator wherein the above described indeterminate force is of a lesser magnitude than in prior art lock mechanisms and which includes unlocking means within the actuator piston rod which can be actuated by fluid pressure or manually.

Another object of the invention is to provide a manual back up systen for emergency unlocking of such a fluid pressure actuator when the fluid pressure source fails.

A further object is to provide a lock indicator switch for such a locking fluid pressure actuator which signals whether or not the locking mechanism is fully locked in the extended position.

Other objects of the invention will be apparent from the description of the invention which follows.

SUMMARY OF THE INVENTION

The objects of the invention are accomplished by providing a fluid pressure actuator and locking means which lock in the extended position, which comprises a hollow cylinder having a head end and a rod end, the rod end being beveled conically outward. A cylinder end cap is received on each end of the cylinder, with an inwardly opening annular recess between the rod end cap and the cylinder rod end. A fluid pressure port in the rod end cap communicates with the cylinder bore. A piston is slidably received in the cylinder with sealing means on the piston engaging the cylinder wall in fluid-tight relationship. A central axial passageway in the piston rod opens toward the rod end cylinder cap. Dual diametrically opposed radial apertures in the piston head communicate with this passageway. An unlocking rod is slidably received in the passageway with sealing means on this rod engaging the wall of the passageway in fluid-tight relationship. Resilient means are provided for biasing the unlocking rod in an outward direction from the cylinder rod end when the main piston is in the extended position. A locking detent is slidably disposed in each of the radial apertures, each detent being chamfered on its outer end for engaging the beveled rod end surface of the cylinder and being provided with a camming surface at its inner end, which surface has an essentially flat portion and a sloped portion, the sloped portion being nearest to the head end of the cylinder. The unlocking rod has a cage at its outer end, which may be integral with the rod. Two rollers are held in alignment normal to the center line of the piston by the cage, but are unrestrained radially by the cage or unlocking rod. Each roller engages a camming surface as each of the detents moves, thereby camming the detents outwardly into the annular recess and locking them in that position, thus locking the piston against movement. Upon admission of retract fluid pressure to the cylinder rod end, the unlocking rod drives the rollers out of their locking position and permits the cylinder end to cam the detents in and thus unlock the piston.

The cage is provided with a central axial rod extension and the piston head with a central axial bore in which the rod extension is slidably received, with sealing means on the rod extension engaging the walls of the bore in a fluid tight relationship.

The central axial passageway in the piston rod which receives the unlocking rod comprises an inner central axial passageway, the wall of which engages the sealing means on the unlocking rod and an outer central axial passageway. A first central axial guide member is positioned within the outer passageway at its inner end. A second central axial guide, spaced outwardly from said first central axial guide is secured to the unlocking rod. A spring is positioned by and compressed between the first and second central axial guides. This spring constitutes the resilient means for biasing the unlocking rod in an outward direction from the rod end when the piston is in the extended position.

Preferably, an intermediate central axial passageway joining the inner and outer passageways and concentric therewith may be provided, such intermediate passageway having an opening at its inner end of smaller diameters than the inner passageway, to which the opening is contiguous. The unlocking rod in this case has a stepped shaft adapted to the difference in diameters between the inner passageway and the opening.

The words, "inner" and "inwardly," as used in this specification refer to a direction toward the cylinder head end and the words, "outer" and "outwardly," to a direction away from the cylinder head end, except where otherwise qualified as by the use of a term such as "radial."

The actuator is preferably provided with manual unlocking means comprising a lever mechanism, which preferably is supported by a member secured to the outer end of the piston rod and adapted to be actuated by and to actuate the outer end of the unlocking rod. In the preferred embodiment, an indicator switch adapted to be actuated by the lever mechanism is mounted on such member. The switch preferably is adapted to open an electrical indicating circuit when the unlocking rod is in the locked position. Instead of being secured to the piston rod, the lever mechanism and/or the indicator switch may be secured to the cylinder rod end cap.

An additional inventive feature is a snubbing sleeve which is slidably received in said cylinder end in a close fitting manner and spring loaded against the cylinder head cap. The snubbing sleeve is adapted to receive the piston head when it retracts, the piston head bottoming against the snubbing sleeve and driving it against the spring, thereby successively closing off the cross port and opening and closing successively smaller orifices until the piston bottoms out.

In the present locking mechanism, as in that of Royster, the high radial load applied to the detents are carried by the rollers, but in the present case, the rollers bear against one another.

As the locking piston is retracted axially, the rollers roll against the detents' camming surfaces and against themselves. Sliding takes place only on the surface normal to the axis of the piston. Forces acting in this direction are much lower than in the radial direction. Thus, the indeterminate force is of a lesser magnitude than in any of the prior art devices. The pressure spread between "always locked" and "always unlocked" is greatly reduced and the lock release mechanism is much more predictable and reliable.

The objects, features and advantages of the invention may be understood by reference to the following description and the appended drawings.

DESCRIPTION OF THE PREFERRED EMBODIMENTS

Figure 1:
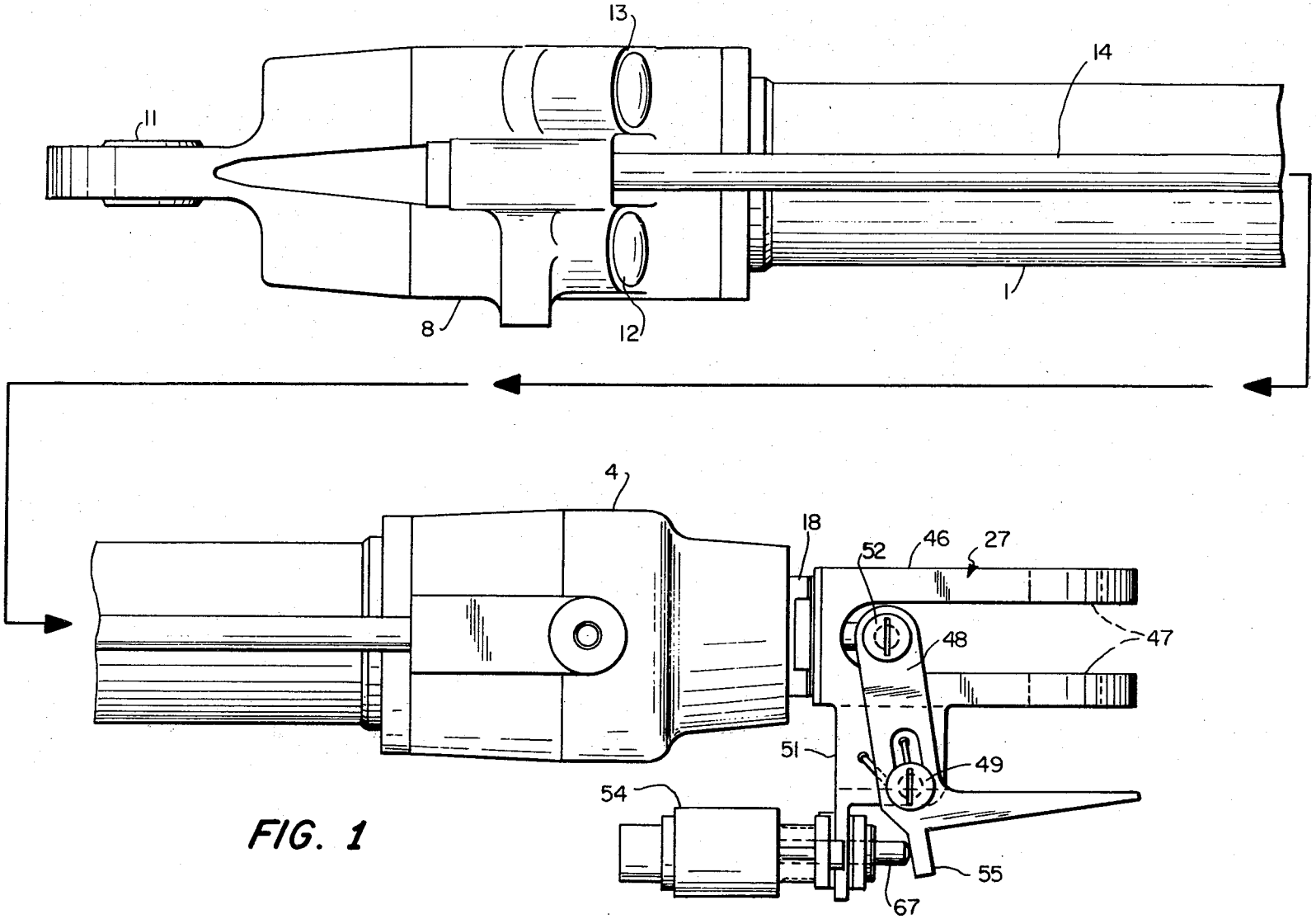
FIG. 1 is a top view of the actuator as employed for a main landing gear door of an airplane, showing the actuator unlocked and in its retracted position.

FIGS. 1 to 5 show a fluid pressure actuator and locking means constructed in accordance with this invention and which comprises an elongated hollow cylinder 1 having a bore 2 therein and having a rod end and a head end. The rod end is beveled conically outward as shown at 3. A cylinder rod end cap 4 is removably secured (as by screw threaded means 5) on the beveled end of the cylinder 1, and suitable packing 6 is provided to form a fluid-tight connection between the cylinder rod end cap 4 and the cylinder 1. The cylinder rod end cap 4 is so constructed as to provide an annular recess 7 between it and the cylinder 1. A cylinder head end cap 8 is removably secured (as by screw threaded means 9) on the cylinder head end, suitable packing 10 being provided to form a fluid-tight connection. The cylinder head end cap 8 is provided with a bearing 11 for facilitating attachment to a cooperating structure. Head end cap 8 is also provided with two fluid pressure ports, retract port 12 and extend port 13. Retract port 12 communicates through tubes 14 and 15 with the annular recess 7. Extend port 13 communicates with the head end of cylinder 1.

A piston 16 is slidably received in the bore 2 of the cylinder 1 and suitable sealing means, such as piston ring 17, are utilized on the piston 16, suitably on piston head 26, for providing a fluid-tight relationship between piston 16 and the wall of cylinder 1. The rod portion 18 of the piston 16 projects from the rod end of the cylinder 1 and is adapted to provide a pushing action in a direction away from the cylinder head end or a pulling action in a direction toward the cylinder head end.

Figure 3:
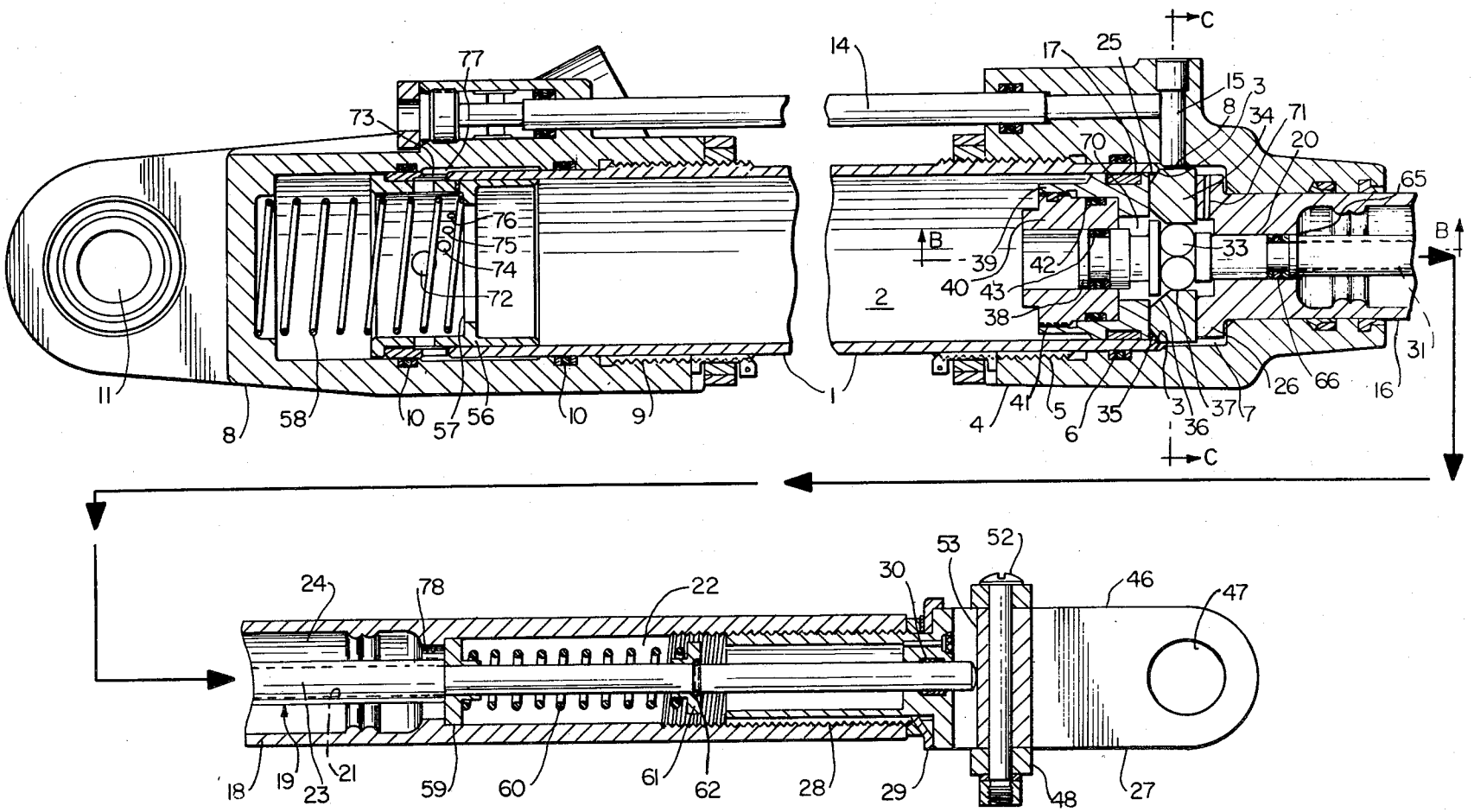
FIG. 3 is a sectional side view of the actuator, showing the actuator locked in its extended position.

The piston rod 18 is provided with a central axial passageway 19, which, as shown, consists of three concentric passageways of circular cross-section, namely an inner passageway 20, an intermediate passageway 21 and an outer passageway 22. One end of intermediate passageway 21 is contiguous with inner passageway 20, and the other end of said passageway 21 is contiguous with outer passageway 22. Intermediate passageway 21 may be provided by a sleeve 23 in a hollowed portion 24 of piston rod 18, said sleeve 23 being held in position by spacing or other means well known in the art. The hollowed out portion 24 is provided merely to reduce the weight of the actuator and is not necessary for the functioning of the unit. Intermediate passageway 21 may be provided by ways other than by the use of sleeve 23. Inner passageway 20 communicates with two diametrically opposed radial apertures 25, which are provided in the piston head 26. Intermediate passageway 21 has a shoulder 78 at the end contiguous to the outer third passageway 22, said shoulder being of smaller diameter than the third passageway. The opening to passageway 21 contiguous to the inner passageway 20 is smaller in diameter than the inner passageway, as indicated at 65. The outer passageway 22 extends to the outer end of piston rod 18. As shown in FIG. 3, intermediate passageway 21 itself is smaller in diameter than both inner passageway 20 and outer passageway 22, but this is not essential.

A rod end assembly 27 is removably secured to piston rod 18 (as by screw threaded means 28 engaging in third passageway 22 and lock washer 29). Rod end assembly 27 is provided with a ring 30 which is positioned concentrically with central axial passageway 19 when the rod end assembly 27 is secured to piston rod 18.

An unlocking rod 31 is slidably disposed in central passageway 19 and ring 30. Suitable packing 66 is utilized to provide a fluid-tight seal between the unlocking rod 31 and the wall of inner passageway 20. The unlocking rod 31 may be provided with a stepped shaft, with the outer portion being of sufficiently reduced diameter that it does not contact the walls of the intermediate passageway 21.

A guide member 59 is secured in a central axial position in the outer passageway 22 contiguous to the shoulder 78 of intermediate passageway 21. One end of a spring 60 rests on guide member 59 positioned at the inner end of outer passageway 22. The spring 60, in a compressed mode, extends outwardly in a central axial position, and the outer end of the spring is in contact with guide member 61, which rests against retaining ring 62, secured to unlocking rod 31, in such a manner as to maintain contraction of the spring 60 when the unlocking rod 31 moves in the outward direction.

Figure 4:
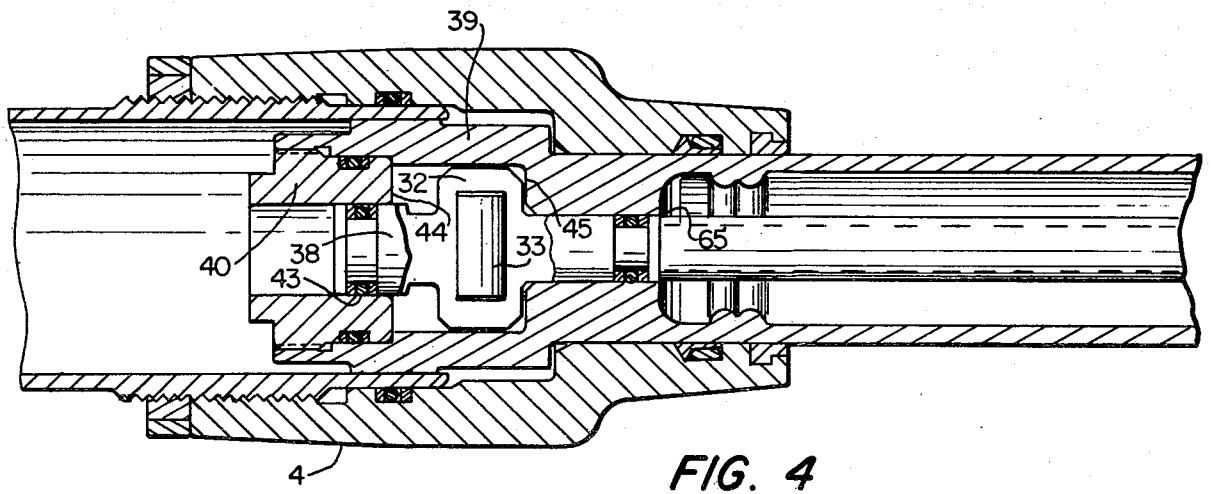
FIG. 4 is a sectional view of the roller cage and associated elements taken along the line B—B of FIG. 3.

As more specifically shown in FIG. 4, the inner end of unlocking rod 31 is provided with a roller cage 32, shown here as integral with the unlocking rod, although it may be made nonintegral. Two rollers 33 are held by the cage 32 in alignment normal to the center line of the piston but being unrestrained radially.

Figure 5:
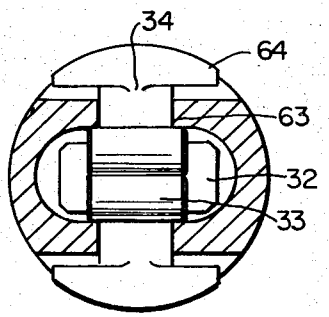
FIG. 5 is a sectional view of the locking elements taken along the line C—C of FIG. 3.
Figure 2:
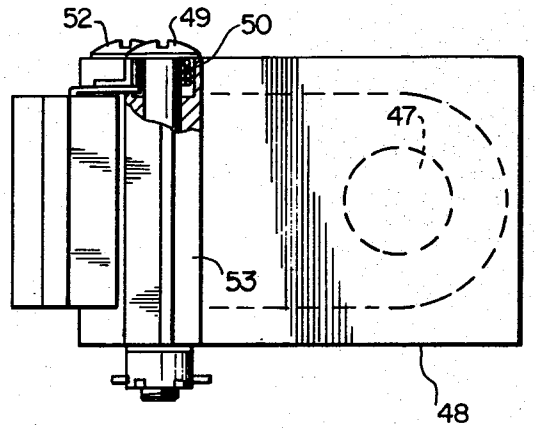
FIG. 2 is a side view of the manual unlocking mechanism and associated elements shown in FIG. 1.

Two locking detents 34 (pawls) are slidably disposed in the radial apertures 25, the outer ends of the detents being provided with beveled surfaces 35 for engaging and cooperating with the beveled surface 3 on the end of cylinder 1. The inner ends of the detents 34 are provided with sloped surfaces 36 terminating in essentially flat surfaces 37. In practice, surface 37 may be formed at a slight angle so that when the actuator is subjected to an axial load and normally encountered deformations occur within the locking mechanism, the surfaces 37 of the opposite detents 34 will remain parallel. As seen in FIG. 5, each detent has a cylindrical portion 63 and a segment portion 64, so that, in this view, each detent resembles a mushroom. In the locked position, the system, consisting of a roller and a detent back to back, with the rollers on the flat portions of the cam ends of the detents, is symmetrical about the piston center line, the detents and rollers being unrestrained radially. The rollers and detents are free to shift slightly radially to adjust for the manufacturing tolerances and permit an exact load sharing between the detents.

The roller cage 32 is provided at its end nearest the cylinder rod end with a generally cylindrical rod extension 38, coaxial with the unlocking rod 31. The rod head 26 consists of a hollow outer generally cylindrical member 39 and an inner cylindrical sleeve 40 removably secured in outer member 39, as by screw threaded means 41, packing 42 being provided to form a fluid-tight connection. Cylindrical member 39 and cylindrical sleeve 40 are co-axial with the piston 16. Cylindrical member 39 also provides a central axial chamber 70 which allows for movement of the roller cage 32 and rod extension 38. A passage 71 is provided in cylindrical member 39, which communicates with chamber 70 at one end and annular recess 7 at its other end. Rod extension 38 is slidably received in cylindrical sleeve 40, suitable packing 43 being provided to form a fluid-tight relationship. The diameter of rod extension 38 at packing 43 is greater than that of unlocking rod 31 at packing 66.

Travel stop surfaces 44 and 45 are provided in the piston head 26 spaced to assure sufficient unlock travel for roller cage 32 to permit detents 34 to retract and to provide for overtravel.

As shown, rod end assembly 27 includes a clevis 46 which provides a bearing 47 for facilitating the attachment of a cooperating structure. A two armed lever 48 is provided, hinged on a bolt 49, an arm of the lever at each end of said bolt, which serves as a pivot. Bolt 49, which is provided with a spring 50, is supported on a clevis extension 51. The lever 48 is provided with a bolt 52 and enclosing spacer 53 attached thereto, serving as a crank. Bolt 52 and spacer 53 are positioned in the path of unlocking rod 31. An indicator switch 54 is secured to the clevis extension 51, positioned to be actuated by lever extension 55. Indicator switch 54 may be of standard construction of the spring loaded type which opens an electrical circuit when actuated.

Instead of being positioned on a rod end assembly secured to piston rod 18, the unlocking lever may be located on the fixed housing, e.g., the cylinder rod end cap 4, in such a manner as to engage a linkage contained within the rod end cap, such linkage being so configured as to actuate the unlocking rod 31 when the actuator is in the locked extended position. The indicating switch may similarly be secured to the rod end cap 4 or elsewhere on the fixed housing.

The head end of the cylinder 1 is provided with a snubbing sleeve 56 which is slidably received in cylinder bore 2 in a close fitting manner. The snubbing sleeve is provided with a flange 57 which is spring loaded against the cylinder end by spring 58.

A large cross port 72 and progressively smaller orifices 74, 75 and 76, for example, are provided in the snubbing sleeve 56. An annular chamber 73 is provided by an internal groove in the cylinder head end and a communicating annular chamber 77 is provided by a space between the cylinder head end and head end cap 8.

In the above described embodiment of the invention, the cylinder and piston are preferably made of 4340 heat treated steel. Preferably, the bore and piston rod are hard chrome plated and ground, while the external portion of the cylinder is cadmium plated. The cylinder end caps are preferably of a 7075T73 aluminum forging.

In operation of the embodiment of the invention shown in FIGS. 1 through 5, in order to extend and lock the piston in the extended position, hydraulic or other fluid pressure is introduced through port 13 to the bore 2 of the cylinder 1. At this time, the unlocking rod 31 is axially displaced inwardly and held in this position by retraction of the detents 34 which are confined in the inward radial direction by cylinder bore 2. The fluid pressure drives the main piston 16 to its extreme extended position. The fluid pressure also impinges on rod extension 38. The pressure on rod extension 38 together with the push exerted by spring 60 results in a movement of roller cage 32, which causes the locking detents 34 to move radially outward and lock against the beveled cylinder end surface 3. Depressurization will not disengage the lock since the spring action on the unlocking rod prevents the radially loaded rollers from uncamming the lock.

The lock can be disengaged by a retract fluid pressure differential or manually. When a hydraulic retract pressure is applied to the actuator, at port 12, this pressure is transmitted through passages 14 and 15 into chamber 7. This force is further tranmitted into the chamber 70 in which the roller cage 32 is located through either the interstices surrounding the detents 34 or by means of passage 71. Due to the differential cross sectional area between seal 43 and seal 66, a resultant force is applied to the unlocking rod 31. When this axially inward directed force is sufficiently large, it overcomes the spring 60 and drives the rollers 33 out of their locking position, thus permitting the cylinder end surface 3 to cam the detents 34 in and disengage the lock.

With the lock disengaged, the piston 16, acting in response to the inwardly directed force exerted on it by the hydraulic pressure, retracts. As the piston 16 nears the fully retracted position, it engages the flange 57 of the snubbing sleeve 56, driving it in the retract direction and compressing spring 58. During initial retraction, the large cross port 72 had been in direct communication with the annular chamber 73 and in turn with the extend port 13, permitting fluid to flow uninhibited from the cylinder 1.

As the snubber sleeve 56 is displaced, the large cross port 72 passes out of the annular chamber formed by the internal groove 77 and is closed off. Simultaneously, progressively smaller orifices 74, 75 and 76, are progressively opened to chamber 73 and shut off from it. This sequentially increasing restriction to flow out of the cylinder provides the required snubbing effect.

In the depressurized mode, the lever mechanism 48 in the clevis 46 will perform the same functions as the differential pressure, permitting actuator unlock.

When the lock engages, the unlock rod 31 extends. This drives the pivot mounted unlock lever 48 causing the lever extension 55 to actuate the switch 54, thereby opening an electrical indicating circuit. The switch 54 thereby serves as a lock indicator.

It will be obvious to those skilled in the art that various changes may be made in the invention without departing from the spirit and scope thereof and therefore the invention is not limited by that which is shown in the drawings and described in the specification, but only as indicated in the appended claims.

I claim:

1. A device for locking a fluid pressure actuator in the extend position and unlocking it from such position by actuating detents, comprising cage means, a pair of rollers retained within said cage means, said rollers including elongated cylindrical members parallel and contiguous one another, said rollers retained by said cage means in alignment normal to the axial center line of the actuator, an unlocking rod extending from one end of said cage means along said actuator center line, a rod extension extending from the opposite end of said cage means along said actuator center line, sealing means on said unlocking rod and said rod extension, means on said unlocking rod retaining one end of an axially positioned spring, said spring normally urging said unlocking rod, cage means, rollers and rod extension in an extended direction along said actuator center line with said actuator in an extend position whereby said rollers urge said detents into a locked condition, and said rod extension having a diameter at its sealing means greater than that of said unlocking rod at its sealing means.

2. The locking device of claim 1, wherein said unlocking rod has a stepped shaft, an outer portion having a smaller diameter than an inner portion, said means for retaining said end of said axially positioned spring being carried on said outer portion.

3. The locking device of claim 1, wherein said cage means is integral with said unlocking rod.

4. The locking device of claim 1, wherein said unlocking rod is adapted to actuate and be actuated by external manual unlocking means.

5. The locking device of claim 4, wherein said external manual unlocking means comprises lever means adapted to cooperate with an outer end of said unlocking rod.

* * * * *